US006170411B1

(12) United States Patent
An

(10) Patent No.: US 6,170,411 B1
(45) Date of Patent: Jan. 9, 2001

(54) WASTE TIRE INCINERATING AND POST-TREATING SYSTEM

(75) Inventor: Byung Kyu An, No. 301, 71-14 Moonhak-dong Nam-ku, Incheon-si (KR)

(73) Assignee: Byung Kyu An (KR)

( * ) Notice: Under 35 U.S.C. 154(b), the term of this patent shall be extended for 0 days.

(21) Appl. No.: 09/431,690

(22) Filed: Nov. 1, 1999

(51) Int. Cl.[7] ..... F23B 7/00; F23N 5/18; F23C 9/00; F23G 7/06; F23G 5/02

(52) U.S. Cl. ..... 110/233; 110/255; 110/186; 110/211; 110/219; 110/248; 110/259; 110/101 CF; 110/101 R; 110/223; 110/267; 110/293

(58) Field of Search ..... 110/186, 210, 110/211, 219, 248, 255, 259, 165 R, 101 C, 101 CF, 101 R, 216, 212, 223, 222, 233, 251, 267, 293, 327, 346 FA

(56) References Cited

U.S. PATENT DOCUMENTS

| | | | | |
|---|---|---|---|---|
| 3,855,950 | * | 12/1974 | Hughes, Jr. et al. . | |
| 3,863,577 | * | 2/1975 | Steever et al. | 110/8 R |
| 4,223,614 | * | 9/1980 | Barkhaus et al. | 110/238 |
| 4,315,468 | * | 2/1982 | Tyer et al. | 110/101 CF |
| 4,331,084 | * | 5/1982 | Fitch et al. | 110/186 |
| 4,430,950 | * | 2/1984 | Foresto | 110/235 |
| 4,452,154 | * | 6/1984 | Kono et al. | 110/346 |
| 4,637,327 | * | 1/1987 | Jorgensen | 110/289 |
| 5,279,234 | * | 1/1994 | Bender et al. | 110/210 |
| 5,370,067 | * | 12/1994 | Finet | 110/346 |
| 5,425,317 | * | 6/1995 | Schaub et al. | 110/346 |
| 5,477,790 | * | 12/1995 | Foldyna et al. | 110/346 |
| 5,511,495 | * | 4/1996 | Kinto et al. | 110/165 A |
| 5,619,938 | * | 4/1997 | Kaneko | 110/346 |
| 5,676,070 | * | 10/1997 | Magamas et al. | 110/245 |
| 5,826,518 | * | 10/1998 | Bhat et al. | 110/216 |
| 5,927,215 | * | 7/1999 | Moriguchi | 110/228 |

FOREIGN PATENT DOCUMENTS

| | | | | |
|---|---|---|---|---|
| 3926762 | * | 2/1991 | (DE) | 110/346 |
| 401305213 | * | 12/1989 | (JP) | 110/346 |

* cited by examiner

*Primary Examiner*—Denise L. Ferensic
*Assistant Examiner*—K. B. Rinehart
(74) *Attorney, Agent, or Firm*—Warner Norcross & Judd LLP

(57) ABSTRACT

A waste tire incinerating and post-treatment system in which waste tires are continuously and efficiently burned. The system includes a waste tire reservoir tank, a hoist, a conveyor system, a tire-size sensing system, an incinerating part, a waste oil purifying part, a waste gas purifying part, and an incineration residual material treating part. Waste tires are accumulated in a waste tire reservoir tank before their incineration. A hoist transfers the waste tires from the waste tank reservoir to a conveyor system. The conveyor system conveys waste tires to an incinerating part. A sensing system senses the size of individual tires on the conveyor system to create tire size data. This size data is used to control and optimize the rate of feeding the waste tires into the incinerating furnace. The incinerating part further includes a material removal mechanism for removing incineration residual materials. The removed incineration residual materials are further treated in an incineration residual material treating part wherein the materials are compressed to squeeze the waste oil therefrom and to obtain compressed incineration residual material blocks, which may be transferred for further processing by the hoist. A waste oil purifying part purifies the waste oil after incineration of the waste tires. A waste gas purifying part purifies the waste gas generated during the incineration of tires. The waste gas purifying part condenses the waste gas into a waste oil. This waste oil captures contaminants contained in the waste gas by spraying this oil through a body of waste gas.

4 Claims, 15 Drawing Sheets

WASTE TIRE INCINERATING AND POST-TREATING SYSTEM

BACKGROUND OF THE INVENTION

1. Field of the Invention

The present invention relates to a waste tire incinerating system in which waste tires can be continuously burned. More specifically, the present invention relates to a waste tire incinerating and post-treating system in which waste tires can be continuously and efficiently burned, and the discharge gas is utilized as an industrial energy in an efficient manner.

2. Description of the Prior Art

Generally, waste tires cause environmental contaminations, and therefore, waste tires are incinerated by using an incinerating apparatus.

Among the waste tire incinerating apparatuses which have been invented so far, there are Korean Patent Publication No. 1995-1465 and 1995-7416 of the present applicant. Further, an apparatus for utilizing the discharge gas of the burnt tires as an energy is disclosed in Korean Utilit Model No. 1995-2884.

However, in these apparatuses, the disposal of the residual materials is not automatic, or only partly automatic.

Further, the overall structure of the apparatus is complicated, and the installation area becomes large, while the facility cost is high.

Further, waste tires cannot be fed in exact amounts continuously into the incinerating apparatus, and therefore, an exact continuous incineration cannot be realized.

Particularly, waste tires have to be fed in exact amounts, if an efficient incineration is to be realized. However, the sizes of waste tires are various, and therefore, the feeding amount of waste tires into the incinerating apparatus cannot be realized with the result that an efficient incineration cannot be achieved.

Further, in a waste tire incinerating apparatus, the residual materials which remain after the incineration have to be completely removed, if a continuous incineration is to be carried out.

However, in the prior art (Korean Patent Publication No. 1995-7416), the residual materials drop down, and then, the dropped residual materials are collected, with the result that the residual materials are handled in an imperfect manner.

Specifically, within the tires, there are steel wires or steel wire nets for their long durability. These steel wires are not burned, and therefore, they remain after the incineration.

That is, the rubber portions of the waste tires are completely burned, and therefore, the ashes are dropped down after the incineration. However, the steel wires remain mounted on the supporting bars, and therefore, they do not drop down.

Consequently, the residual steel wires have to be pulled sideward to remove them.

However, during the removal of the residual steel wires in this manner, the incinerating operation has to be halted. As a result, a continuous incineration cannot be realized, the incineration cannot be made automatic, and the operation is inefficient.

Further, in addition to the problem of the residual materials, the post treatment of purifying the discharge gas so as to use it as a fuel cannot be carried out in a perfect manner. Therefore, the combustion efficiency of the discharge gas is not high, and the environment is polluted.

SUMMARY OF THE INVENTION

The present invention is intended to overcome the above described disadvantages of the conventional techniques.

Therefore it is an object of the present invention to provide a waste tire incinerating and post-treating system, in which the incinerating system is automatic, the facility cost is lowered, a continuous incineration is realized, and the waste gas purifying efficiency is improved, thereby maximizing the recycling efficiency for the waste gas.

In achieving the above object, the present invention is characterized in that a hoist carrying apparatus is utilized so as to improve the waste tire automatic feeding and the post treatment.

Further, the sizes of the waste tires are sensed when feeding the waste tires into a thermally decomposing furnace, thereby feeding proper amounts of the waste tires into the thermally decomposing furnace, realizing an efficient incineration, and making it possible to continuously handle the residual materials in a continuous automatic manner.

Further, a purifying apparatus purifies the discharge gas to improve the purity of the discharge gas, thereby making it possible to realize a perfect combustion of the discharge gas time.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
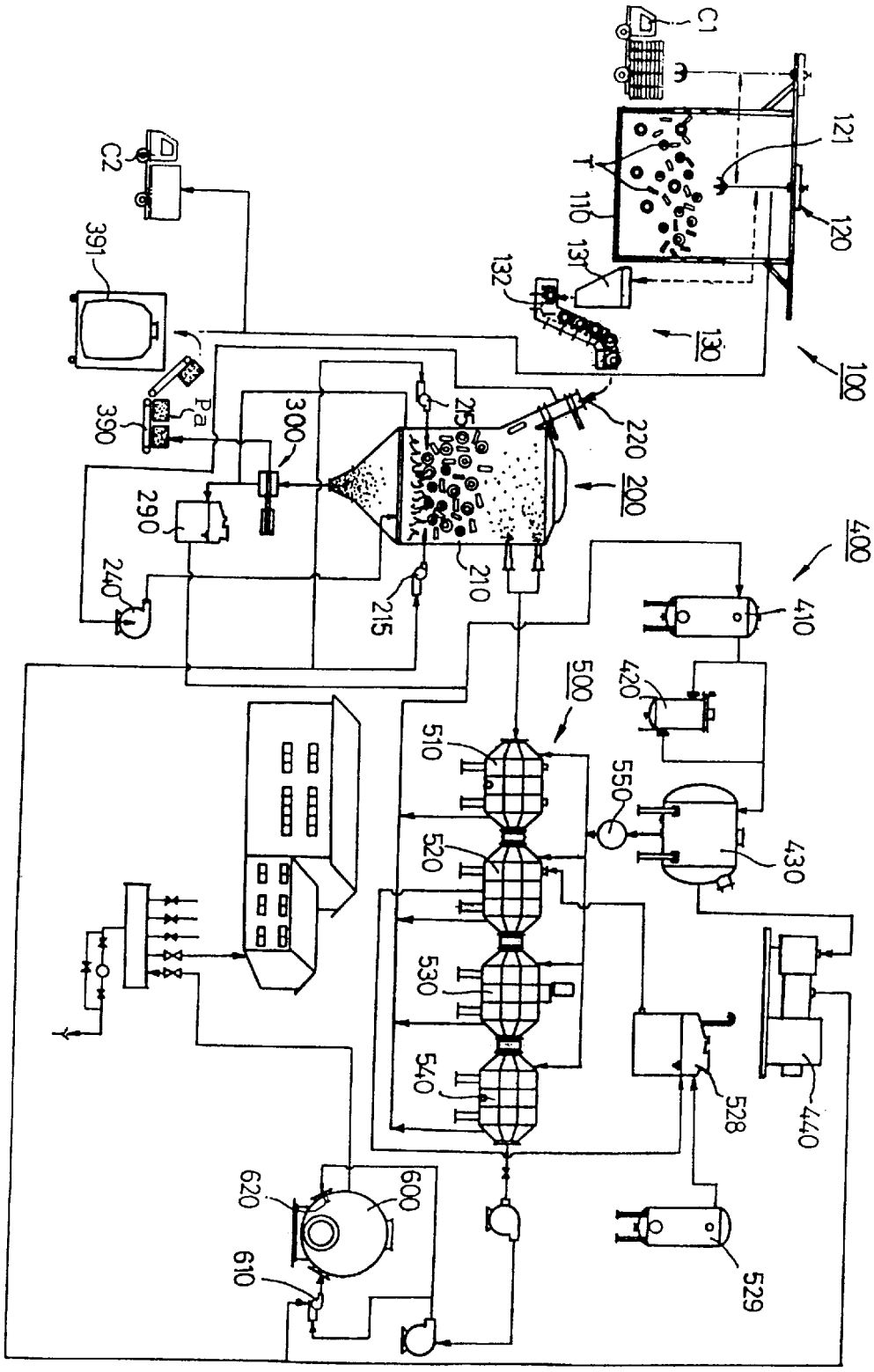
FIG. 1 illustrates the overall system according to the present invention.

FIG. 1 illustrates the overall system according to the present invention.

Referring to FIG. 1, the system according to the present invention includes: a waste tire supplying part 100 for supplying collected waste tires T to incinerate them; an incinerating part 200 for thermally decomposing and incinerating the waste tires T; and an incineration residual material treating part 300 for carrying out a post treatment on the incineration residual materials P such as carbon powders and steel wires.

Further, the system includes: a waste oil purifying part 400 for purifying and storing a waste oil after obtaining it as a byproduct of the waste tire incineration; and a waste gas purifying part 500 for purifying a waste gas after obtaining it as a byproduct of the waste tire incineration.

Referring to FIG. 1, the waste tire supplying part 100 includes a waste tire reservoir tank 110 on which a hoist device 120 is installed. The hoist device 120 is a carrying device which is well known, and therefore, a description on it will be skipped.

Thus when a waste tire collecting truck C1 arrives, a tongs 121 of he hoist device 120 picks up the waste tire from the collecting truck C1, and drops the waste tires into the reservoir tank 110. Thus the waste tires T receive a waiting status. In this manner, the hoist device 120 is operated until all of the waste tires T are moved to the waste tire reservoir tank 110.

Then the hoist device 120 transfers the waste tires one by one from the waste tire reservoir tank 110 to a waste tire supplying and sensing device 130, and then the waste tires are dropped into a guide hopper 131. Under this condition, the guide hopper 131 aligns the waste tires T.

Figure 2:
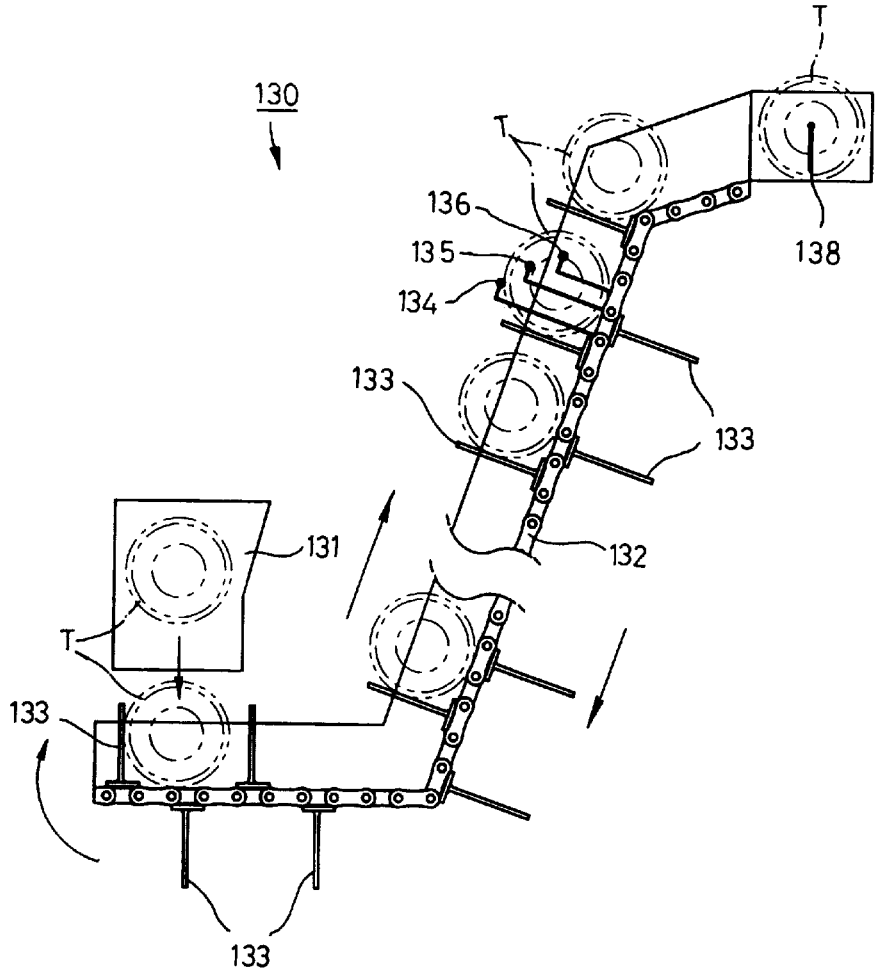
FIG. 2 is an elevational view showing the waste tire feeding device according to the present invention.
Figure 3:
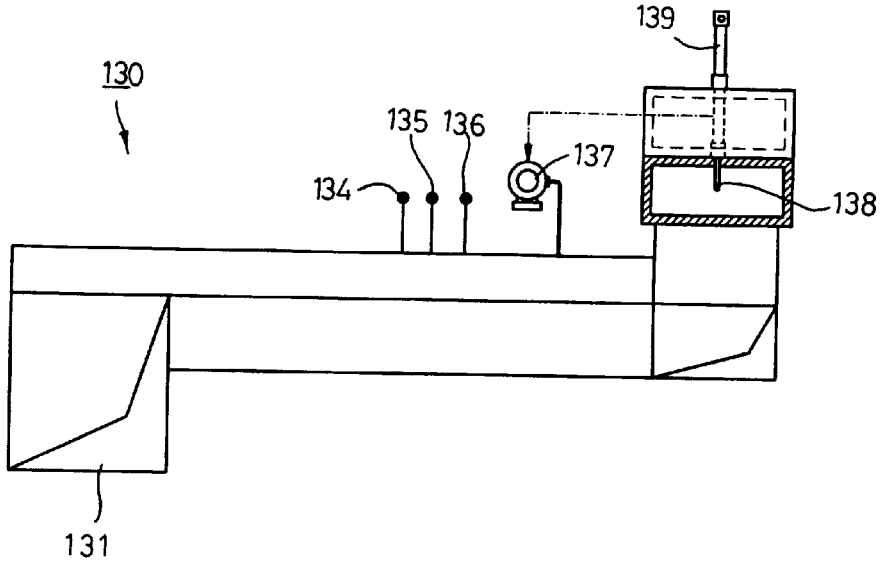
FIG. 3 is a plan view of the waste tire feeding device of FIG. 2.

Referring to FIGS. 2 and 3, the aligned waste tires T are supplied mounted on a chain conveyor 132. The chain conveyor 132 is driven by a motor, and the power relation and the structure of the auxiliary structures such as a chain gear are well known, and therefore, will be described, in brief detail.

That is, tire guide members 133 are equidistantly installed on the chain conveyor 132. Therefore, each of the waste tires is dropped in-between the tire guide members 133 to be confined between the tire guide members, and thus, each of the waste tires is slowly conveyed by being mounted on the chain conveyor 132.

During the conveying of the waste tires T, their sizes are sensed. That is, their sizes are sensed by a large tire sensor 134, a medium tire sensor 135 and a small tire sensor 136 which are installed on the conveying path.

That is, the large, medium and small sensors 134–136 sense the sizes of the waste tires during their conveying, and the sensed data are transmitted to a central processing part (not illustrated). The central processing part controllably feeds the waste tires into the incinerating part 200 based on the received data.

For example, the number of the waste tires T which are incinerated and handled by the incinerating part 200 per unit of time has been already known by an experiment. Based on this experimental data, the number of the waste tires T to be fed per unit of time is decided.

Further, if the sizes of the feeding waste tires T are sensed, then their weight and volume can be known, because they are standardized. Then the data are transmitted to the central processing part.

Therefore, in accordance with the incinerating rate of the incinerating part 200, proper amounts of the waste tires T can be controllably fed in a continuous manner.

Thus the waste tire supplying and sensing device 130 makes it possible to feed proper amounts of the waste tires T, and therefore, a continuous automatic system can be built.

Before feeding the waste tires T into a feeding pipe 220, a possible presence of water within the waste tires T has to be removed. If water is present there, the incineration efficiency is markedly decreased, and therefore, the water is removed beforehand.

Figure 2A:
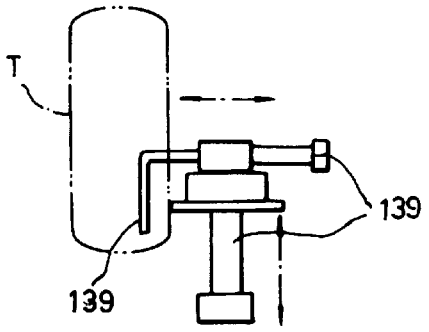
FIG. 2*a* illustrates the water discharge pipe of the waste tire feeding device according to the present invention.

Referring to FIGS. 2*a* and 3, a water discharge pump 137 sucks the water from within the waste tire into a water sucking pipe 138 to discharge the water. The water sucking pipe 138 is movable up and down and to front and rear by a cylinder 139. In this manner, the water sucking pipe 138 is inserted into the interior of the waste tires to suck the water.

Figure 4:
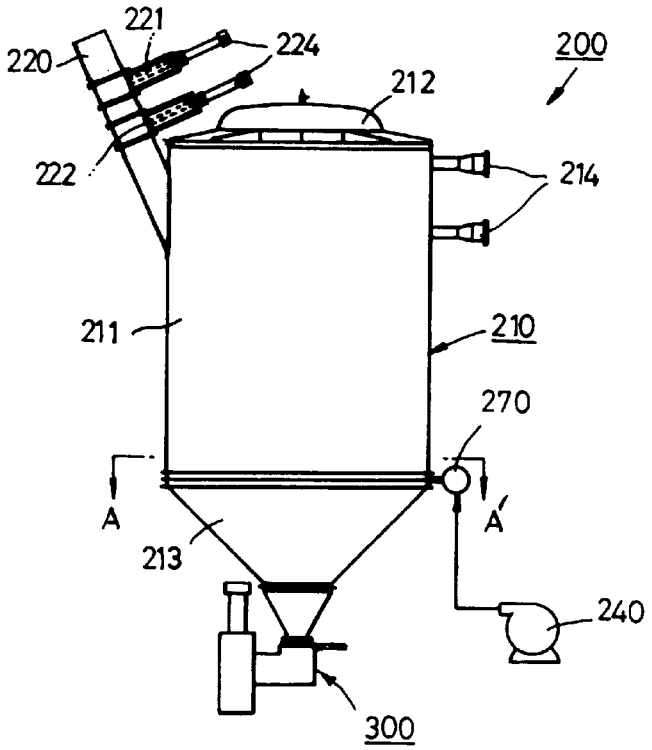
FIG. 4 is an elevational view of the thermal decomposing furnace of the incinerating part according to the present invention.

FIG. 4 is an elevational view of the incinerating part 200 according to the present invention. The incinerating part 200 includes a thermally decomposing furnace 210. A feeding pipe 220 which is installed on the upper portion of the thermally decomposing furnace 210 is provided with a first blocking gate 221 and a second blocking gate 222 at a certain interval.

Therefore, a waste tire waiting space 223 is formed between the first and second blocking gates 221 and 222. The first and second blocking gates 221 and 222 are movable to front and rear by pneumatic cylinders 224. Pneumatic units for driving the pneumatic cylinders 224 are well known, and therefore, descriptions on the pneumatic cylinders will be skipped.

Figure 5:
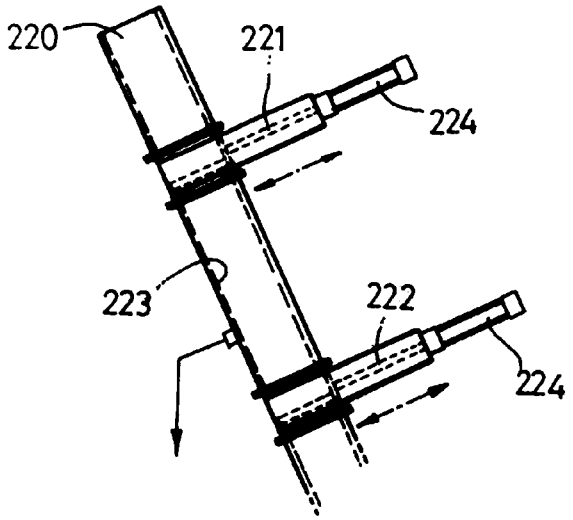
FIG. 5 is an elevational view of the feeding pipe of the thermal decomposing furnace according to the present invention.

Referring to FIG. 5, when feeding the waste tires, first the first blocking gate 221 is opened, so that one single waste tire T can be fed through the feeding pipe 220. The waste tire T thus having passed the first blocking gate 221 awaits mounting on the second blocking gate 222.

Then the first blocking gate 221 is closed, and then the second blocking gate 222 is opened.

Then the waste tire T is dropped into the interior of the thermally decomposing furnace 210, and then, the second blocking gate 222 is closed, thereby closing the feeding pipe 220.

During the feeding of the waste tire T when the second blocking gate 222 is open, the waste gas is discharged momentarily from the thermally decomposing furnace 210 through the feeding pipe 220 to the outside. Thus if the waste gas is discharged each time when a waste tire is fed, then air pollution would be released.

However, the first blocking gate 221 is in a closed state, and therefore, the waste gas is confined within the space between the first and second blocking gates 221 and 222.

Referring to FIG. 1 again, the waste gas which has been confined within the waste tire waiting space 223 is fed back into the thermally decomposing furnace 210 by a blower 240.

Therefore, when the waste tires T are fed through the feeding pipe 220, any leakage of the waste gas can be completely prevented, thereby protecting the environment from being polluted.

Referring to FIG. 4, the thermally decomposing furnace 210 includes a main body 211, a lid 212 and a tapered residual material dropping part 213 to seal off the furnace 210.

On the boundary between the main body 211 and the tapered residual material dropping part 213, there is a waste tire supporting part 250 to support the waste tires T after feeding of them.

Figure 6:
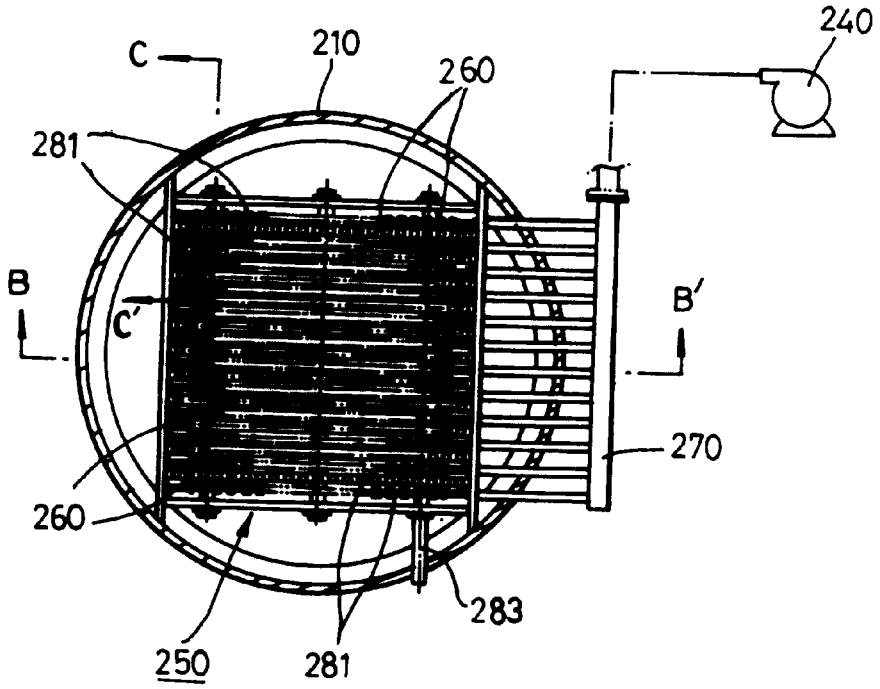
FIG. 6 is a sectional view taken along a line A-A' of FIG. 4.

Referring to FIG. 6, the fixed frame of the waste tire supporting part 250 consists of a plurality of air supplying tubes 260 which are equidistantly fixedly arranged.

Further, the plurality of the air supplying tubes 260 are connected to a main air supplying pipe 270.

Figure 7:
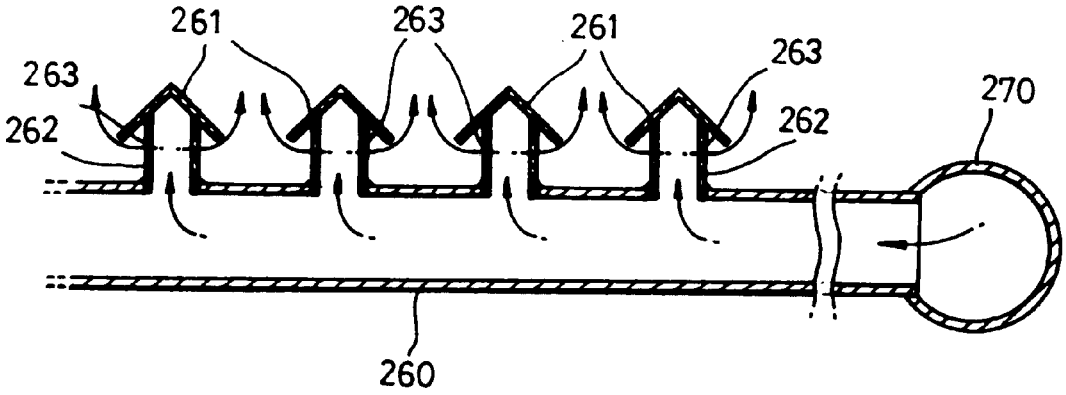
FIG. 7 is a sectional view taken along a line B-B' of FIG. 6.

Referring to FIG. 7, each of the air supplying tubes 260 has a plurality of air discharge tubes 262, each of the air discharge tubes 262 being covered with a cover 261. Each of the air discharge tubes 262 has air discharge holes 263 on the side wall thereof. Thus the air is supplied through the side holes, and therefore, any clogging of the holes can be prevented.

Figure 8:
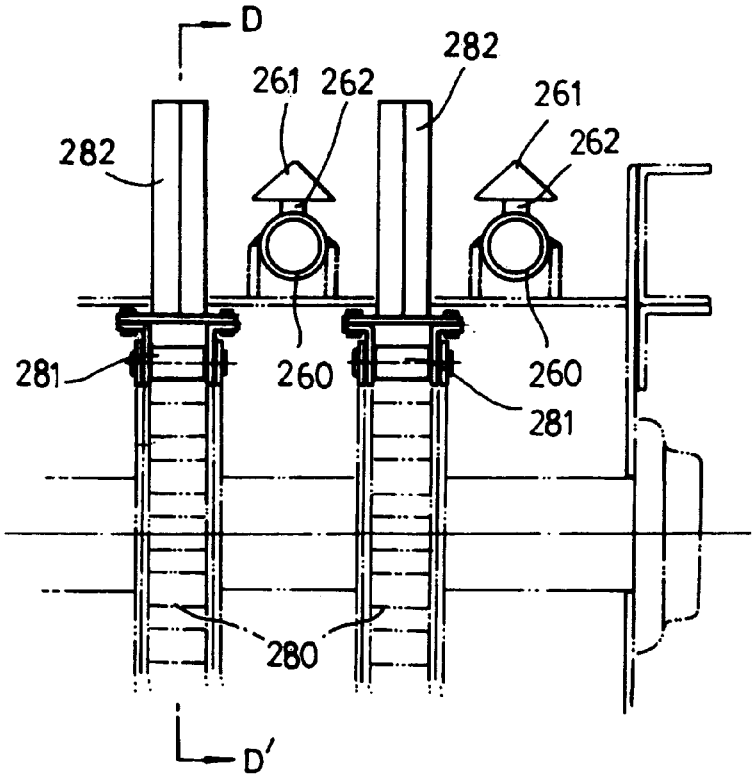
FIG. 8 is a sectional view taken along a line C-C' of FIG. 6.
Figure 10:
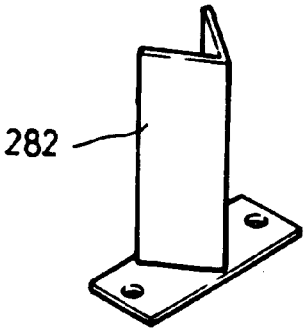
FIG. 10 is a detailed illustration of the portion E of FIG. 9.

Referring to FIG. 8, between the air supplying tubes 260, there are installed recycling chains 281 which run by being driven by chain gears 280. Further, as shown in FIG. 10, a plurality of angled recycling members 282 upstand equidistantly on each of the recycling chains 281.

Figure 9:
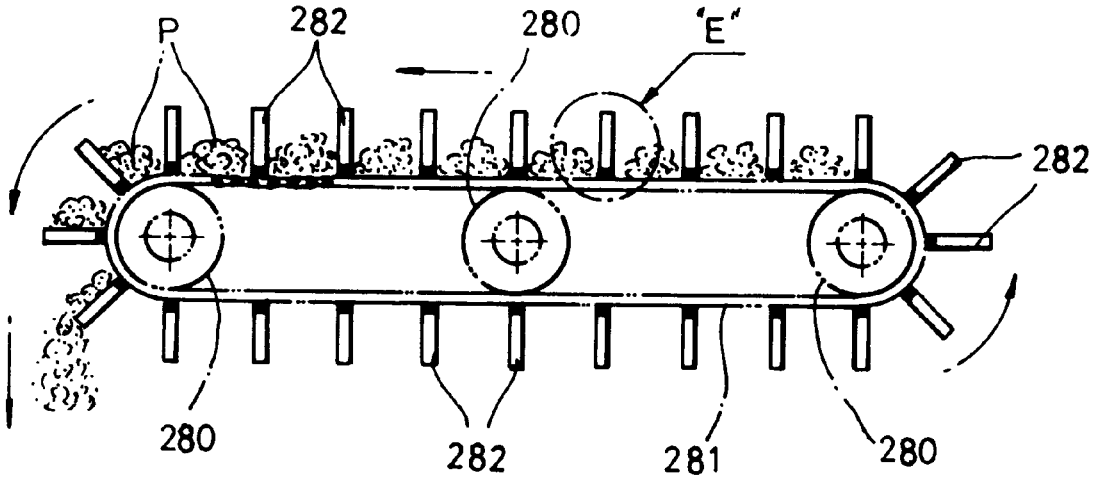
FIG. 9 is a sectional view taken along a line C-C' of FIG. 8.

Referring to FIG. 9, the plurality of the recycling chains 281 run by being driven by a motor 283. Therefore, the recycling members 282 move horizontally. In this manner, the recycling members 282 push the incineration residual materials (the combustion debris) P such as carbon ashes and steel wires to one side, and therefore, the incineration residual materials are dropped down into the residual material dropping part 213.

Figure 11:
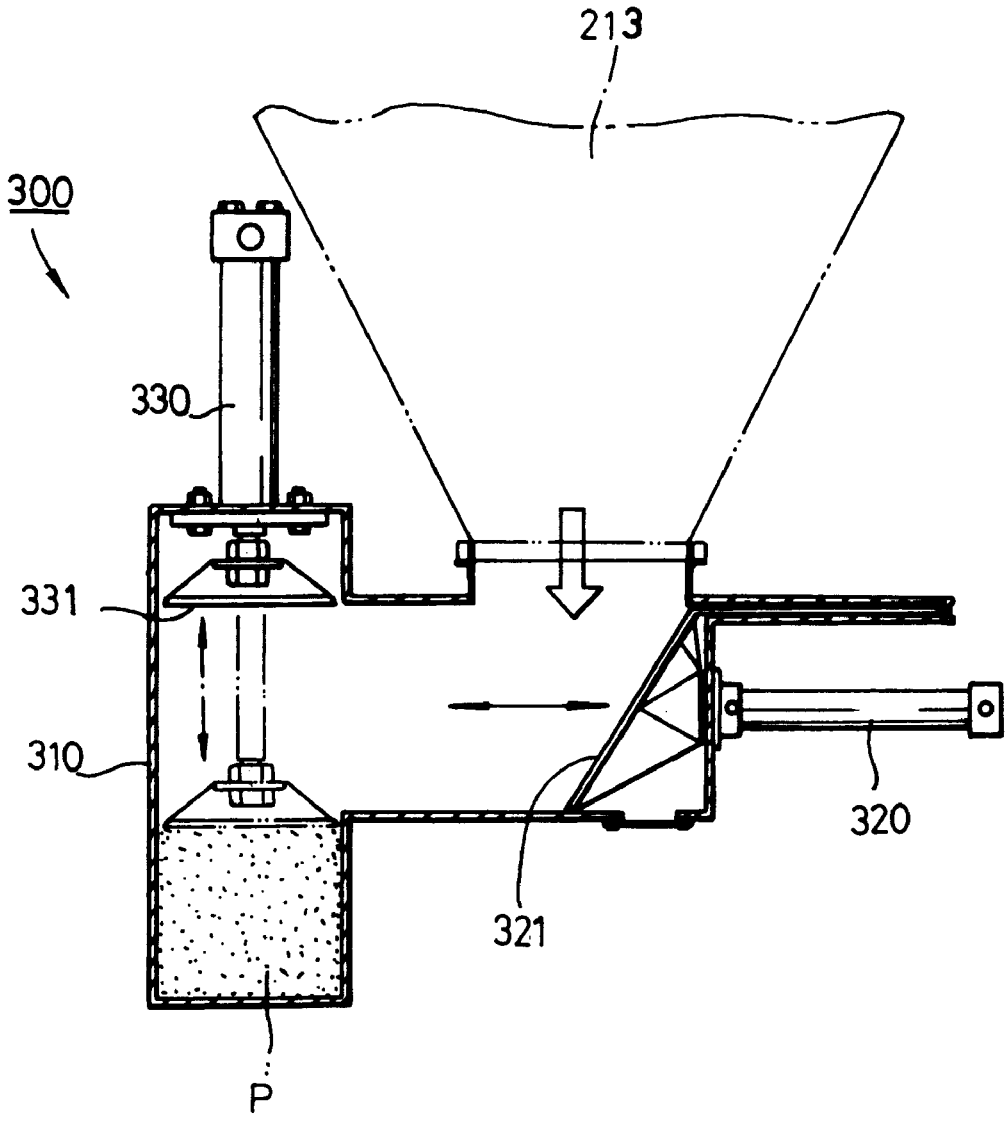
FIG. 11 is a longitudinal sectional view of the incineration residual material disposing part according to the present invention.
Figure 12:
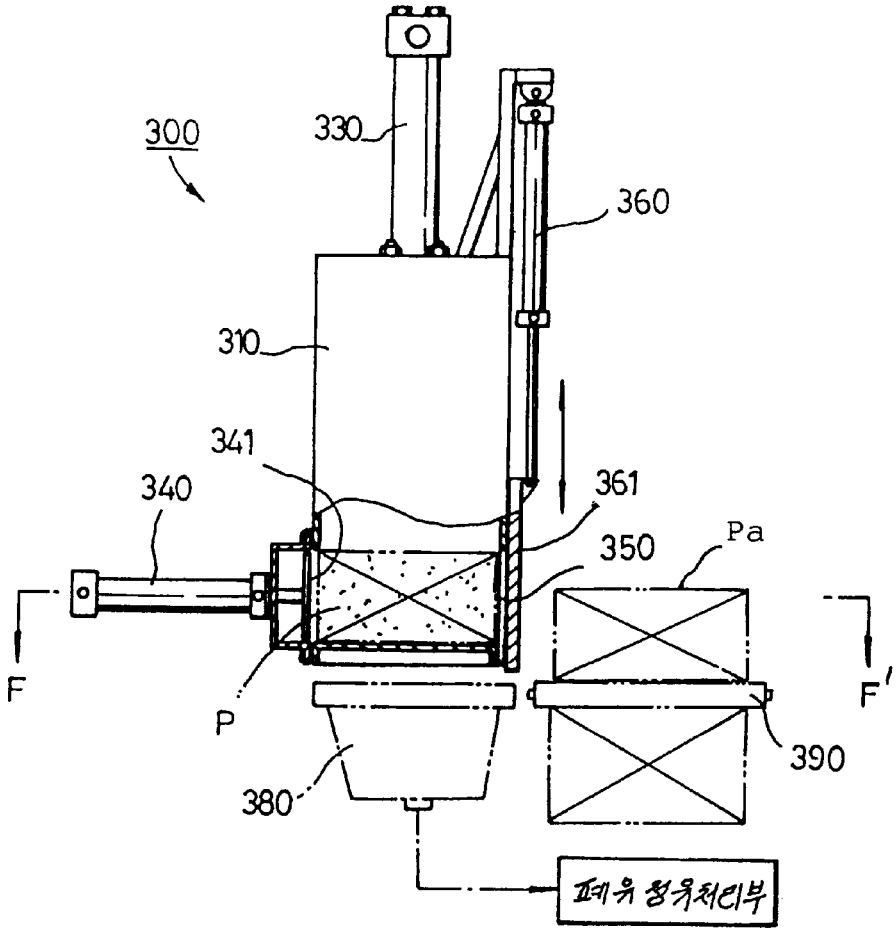
FIG. 12 is a left hand sectional view of the incineration residual material disposing part of FIG. 11.
Figure 13:
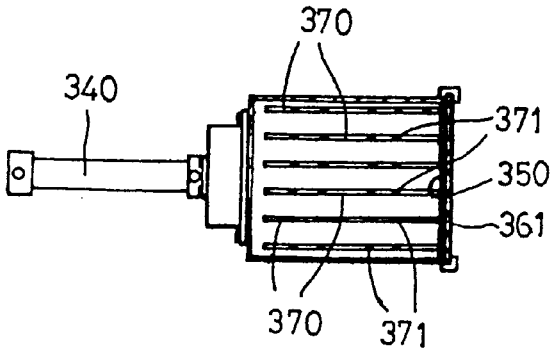
FIG. 13 is a sectional view taken along a line F-F' of FIG. 12.

FIGS. 11 to 13 illustrate the incineration residual material treating part 300. Referring to FIG. 11, the incineration residual materials P are dropped from the residual material dropping part 213 to a residual material compressing part 310. Under this condition, an adjustment may be carried out by means of a remote controlled damper or the like, so that a proper amount of the incineration residual materials can be dropped at a time.

The incineration residual materials P which have been dropped into the residual material compressing part 310 are pushed by a first compressing plate 321 which is driven by a first cylinder 320. Then the incineration residual materials P which have been pushed are compressed by a second compressing plate 331 which is driven by a second cylinder 330.

Then as shown in FIG. 12, the incineration residual materials P are compressed by a third compressing plate 341 which is driven by a third cylinder 340. Under this condition, a residual material outlet 350 is in a closed state by being closed by a door 361 which is driven by an opening/closing cylinder 360.

When the incineration residual materials P are compressed by the third compressing plate 340, the oil which is contained in the residual materials is squeezed and flows down.

Then as shown in FIG. 13, the squeezed waste oil is discharged through oil discharge holes 371 of oil guides 370. In this manner, the waste oil drops into a waste oil hopper 380 of FIG. 12 to be guided to a waste oil treating part 400.

Meanwhile, when the waste oil is completely squeezed, the incineration residual materials P becomes a incineration residual material block preferably parallelopiped Pa. This incineration residual material block Pa is pushed by the third compressing plate 341 of the third cylinder 340 upon opening of a door 361 and is discharged to the outside.

As shown in FIG. 1, the discharged incineration residual materials Pa are conveyed by a conveyor 390 or the like to be stored in a vessel 391. Then the incineration residual materials are picked up by a tongs 121 of a hoist device 120 to be loaded on a collecting truck C2 so as to be transported and disposed of.

Referring to FIG. 1, when the waste tires are incinerated in the thermally decomposing furnace 210, waste oil and waste tires are burned, while carbon powders and steel wires remain unburnt. However, an unburnt waste oil flows down along the inner wall of the thermally decomposing furnace 210, and then the unburnt oil is collected into a waste oil tank 290.

The waste oil of the waste oil tank 290 is carried to the waste oil purifying part 400 to be purified into a combustible oil. The waste oil purifying part 400 includes an oil precipitator 410, an oil centrifugal separator 420 and an oil tank 430. These components have the well known structures, and therefore, will not be described in detail.

Thus the waste oil passes through the oil precipitator 410 and the oil centrifugal separator 420. In this manner, foreign materials such as floating materials or sediments are removed, and then, the purified oil is stored in the oil tank 430. Then the oil of the oil tank 430 is sent to an emulsifying device 440 to be emulsified.

In the emulsifying device 440, a proper amount of water is added to emulsify the oil, and to decompose the sludge within the oil. Then this oil is supplied to an oil burner 610 by precisely controlling the pre-heating temperature, so that an aqueous gas reaction and a complete combustion would be carried out. In this manner, the air polluting materials are made to be burned to a high degree, and a fuel saving is achieved. The emulsified waste oil is mostly recycled to an oil burner 610 of a boiler 600 or the like.

Further as shown in FIG. 1, the recycling waste oil may be supplied to an initial burner 215 of the body part 211 of the thermally decomposing furnace 210, so that initial flames can be provided to the waste tires to be incinerated.

When the waste tires begin to be burned by receiving flames from the initial burner 215, the waste tires will continue to be burned by the flames. Therefore the recycling waste oil is no longer required.

Meanwhile, the waste gas which is discharged through the gas discharge hole 214 of the thermally decomposing furnace 210 contains foreign materials such as dust. Therefore, the waste gas is sent to the waste gas purifying part 500 to be purified there.

The waste gas purifying part 500 includes a first oil filter 510, an oil cooler 520, an oil cyclone 530 and a second oil filter 540. FIGS. 14 to 19 illustrate this waste gas purifying part 500.

Figure 14:
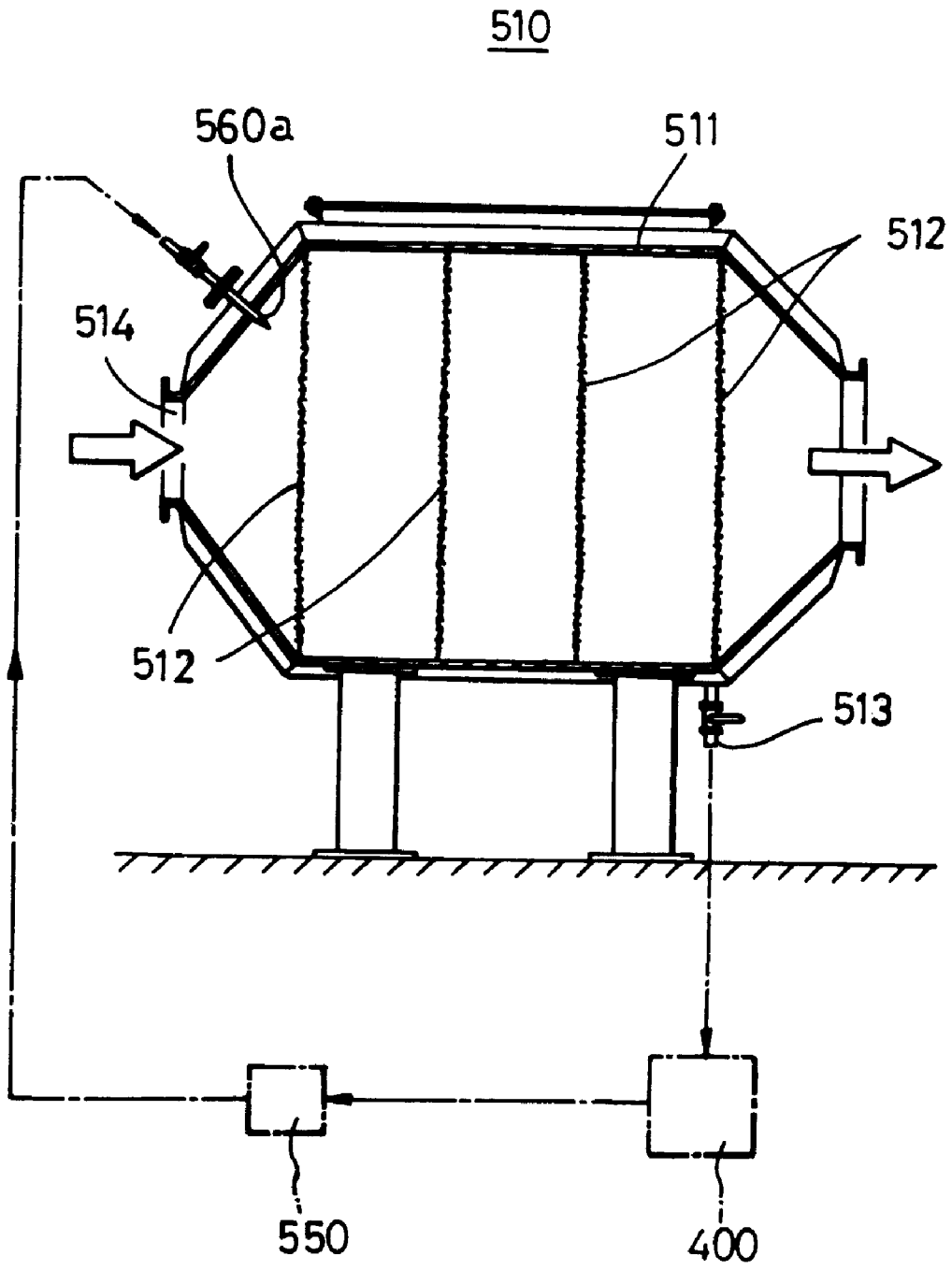
FIG. 14 is a longitudinal sectional view of the first oil filter according to the present invention.

Referring to FIG. 14, the first oil filter 510 includes a plurality of filter members 512 which are equidistantly disposed within a tank 511 and on each of which small holes are formed. Therefore, when the waste oil passes through the filter members 512, the foreign materials and the waste oil contained in the waste gas are agglomerated on the walls of the filter members to flow down.

Then the waste oil is discharged through an oil discharge hole 513 to the waste oil purifying part 400. Then the waste oil is spouted through an oil nozzle 560*a* of the upper portion of the tank 511 by a high pressure pump 550. Thus, the waste oil is spouted into the waste gas, and therefore, the dust particles of the waste gas are captured by the spouted oil drops, with the result that the oil drops with the dust particles drop down. As a result, the spouted waste oil removes the dust particles from the waste gas, and therefore, the waste gas purifying efficiency is further improved.

Figure 15:
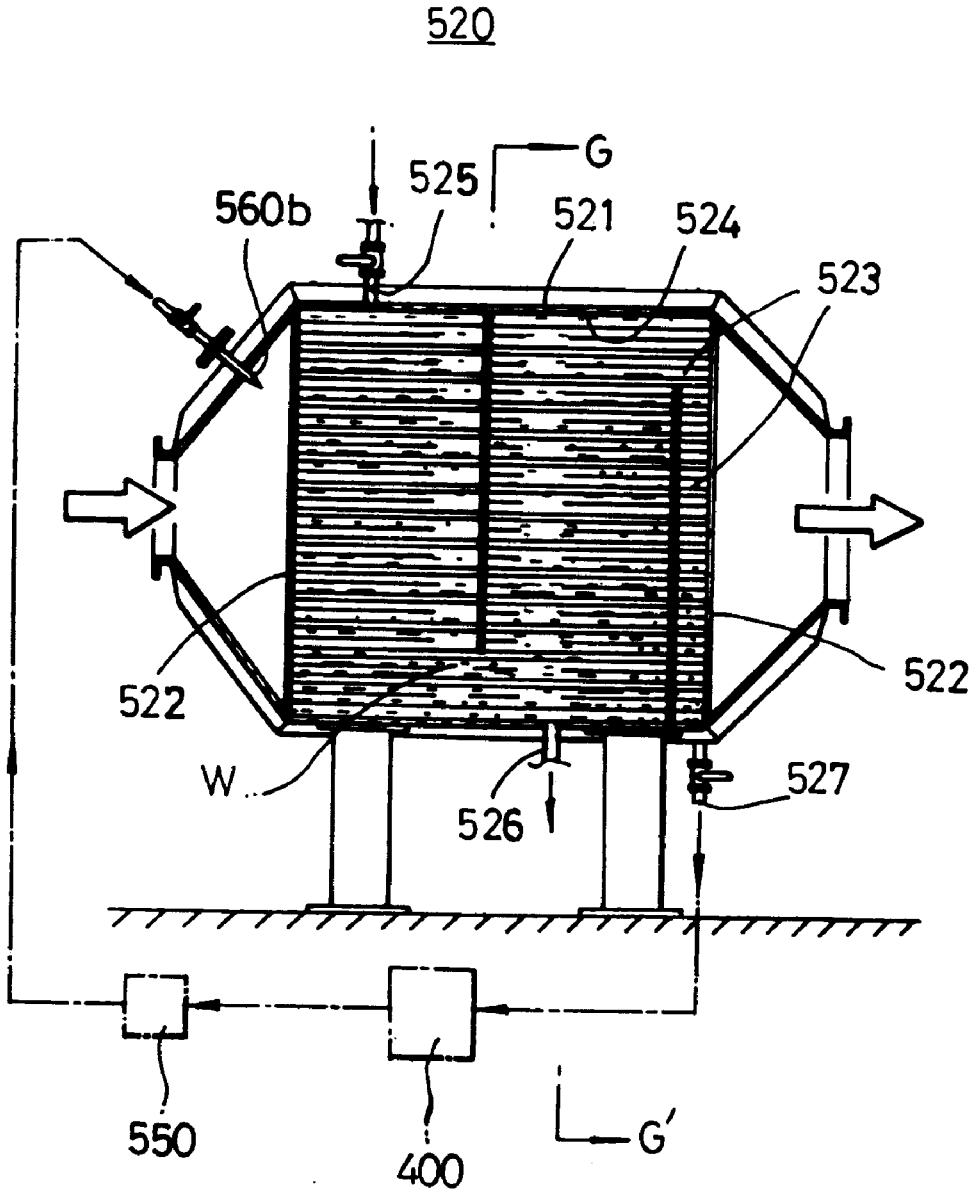
FIG. 15 is a longitudinal sectional view of the oil cooler according to the present invention.
Figure 16:
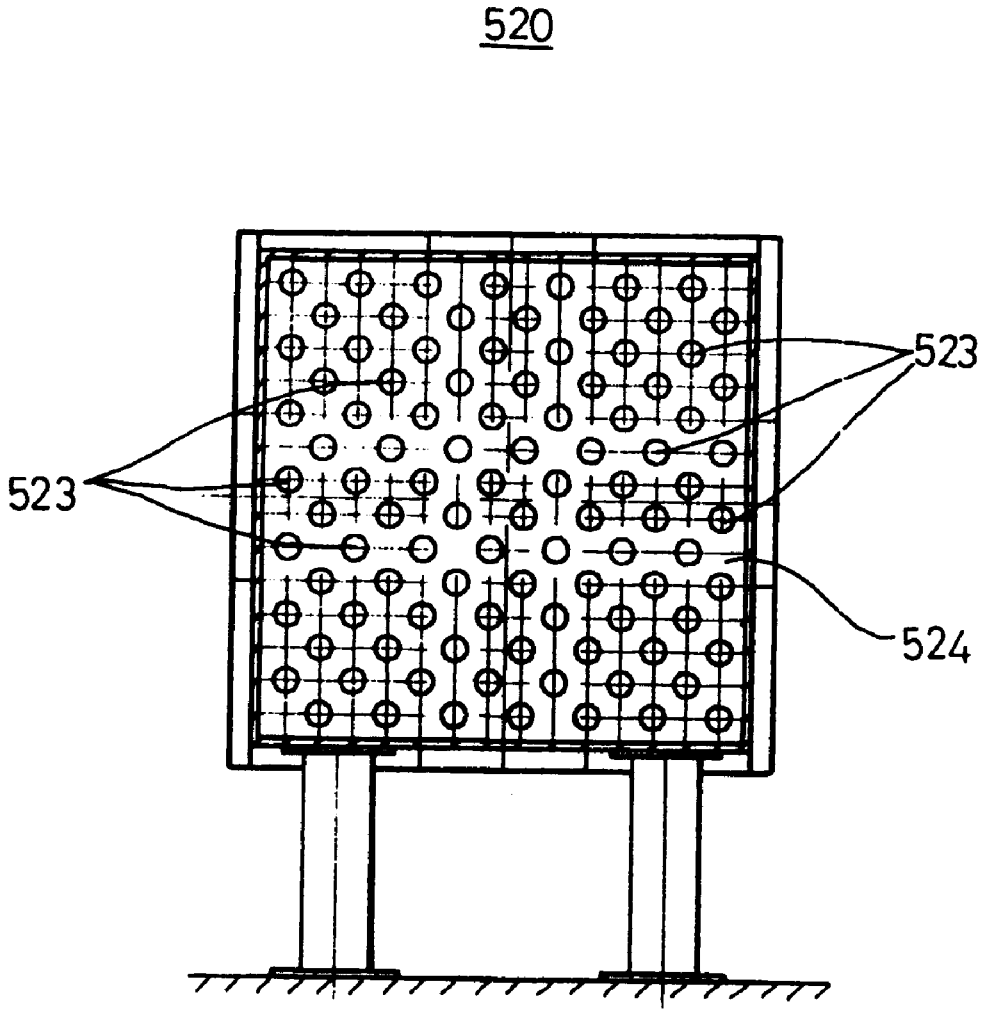
FIG. 16 is a sectional view taken along a line G-G' of FIG. 15.

Now the waste gas purifying steps will be described in detail referring to FIGS. 15 and 16.

In the oil cooler 520, a pair of supporting plate members 522 are disposed on both sides of the inner wall of a tank 521. Further, between the supporting plate members 522, there are installed a plurality of gas tubes 523 for passing the waste gas. The plurality of the gas tubes 523 pass through a water chamber 524. A cooling water W is supplied through a water inlet 525 into the water chamber 524, and is drained out of the water chamber 524 through a water outlet 526.

The reservoir of the cooling water is a water tank 528, and the drained cooling water is circulated back to the water tank 528. Reference code 529 indicates an auxiliary water tank from which the cooling water is supplied to the water tank 528.

Therefore, the waste gas is cooled by the cooling water W during passage through the gas tubes 523. Further, the waste oil is separated from the waste gas. Further, the separated waste oil is drained through an oil outlet 527 into the waste oil purifying part 400. Then the separated waste oil is spouted through an oil nozzle 560b of the tank 521 by a high pressure pump 550, so that the spouted oil drops can capture the dusts contained in the waste gas, thereby further improving the waste gas purifying efficiency.

Figure 17:
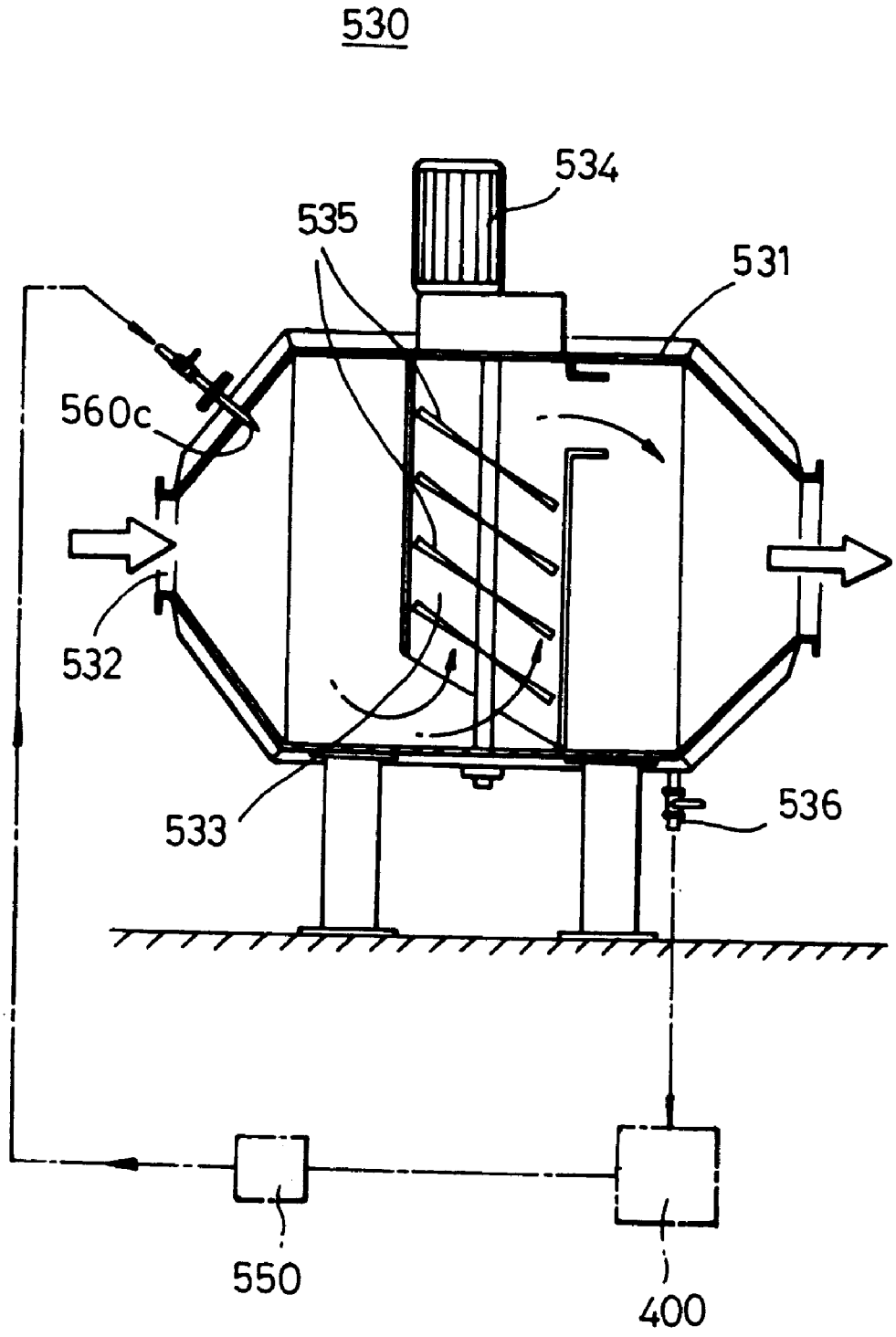
FIG. 17 is a longitudinal sectional view of the oil cyclone according to the present invention.

A next oil purifying step is done by an oil cyclone 530 as shown in FIG. 17. In the oil cyclone 530, the waste gas which is incoming through an inlet 532 of a tank 531 is introduced into a helical guide path 533. Within the helical guide path 533, the waste gas forms a helical flow by a propeller 535 which is driven by a motor 534.

Therefore, the waste oil contained in the helical flow of the waste gas collides with the propeller blades, and therefore, the collided waste oil is separated from the waste gas. Thus the separated waste oil is discharged through a waste oil discharge hole 536 to the waste oil purifying part 400.

Further, the separated waste oil is spouted through an oil nozzle 560*c* of the tank 531 by being driven by a high pressure pump 550, so that the spouted oil drops can capture the dusts contained in the waste gas, thereby further improving the waste gas purifying efficiency.

In this oil cyclone 530, two or more propellers 535 are installed, thereby improving the treating speed and efficiency.

Figure 18:
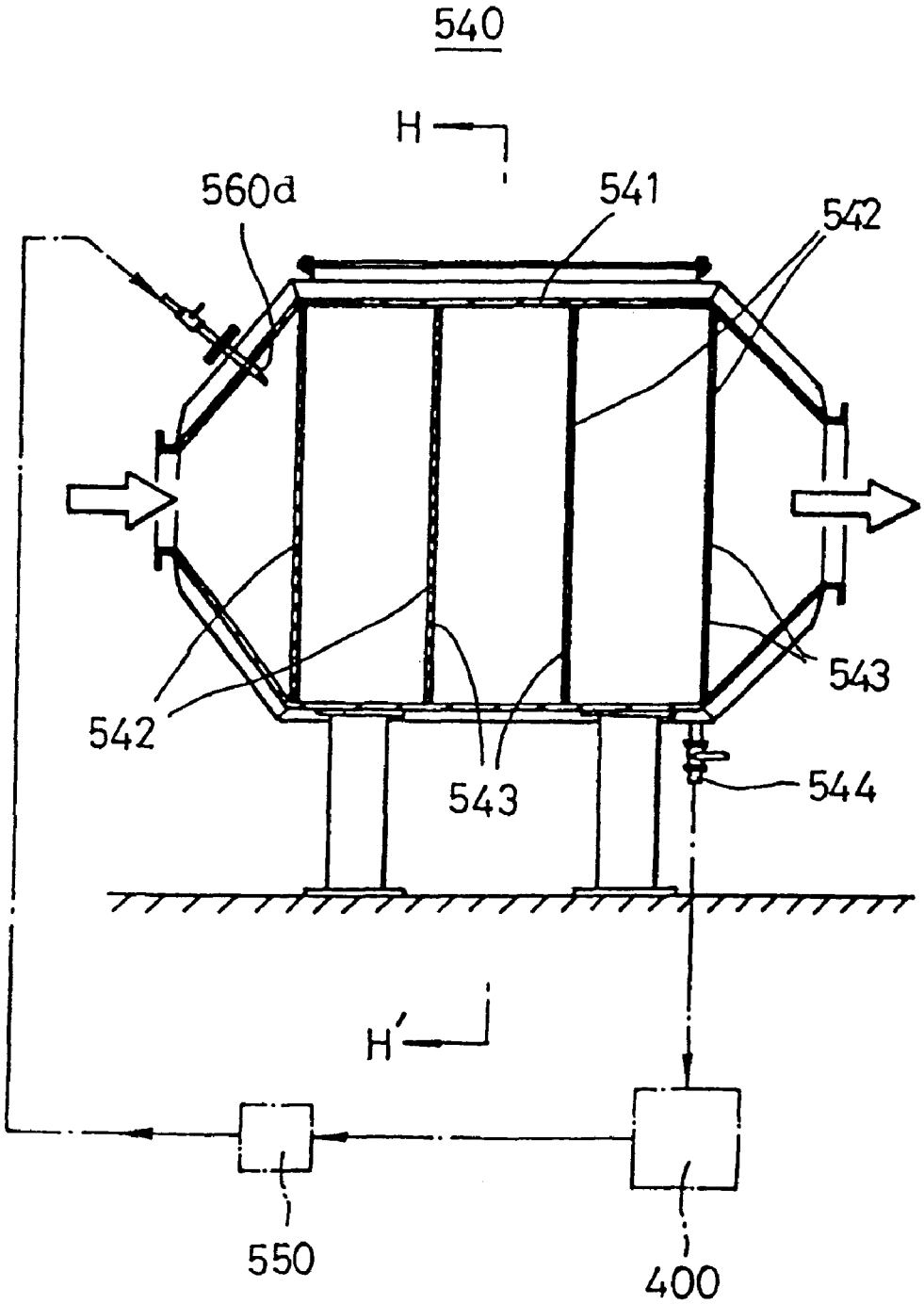
FIG. 18 is a longitudinal sectional view of the second oil filter according to the present invention.
Figure 19:
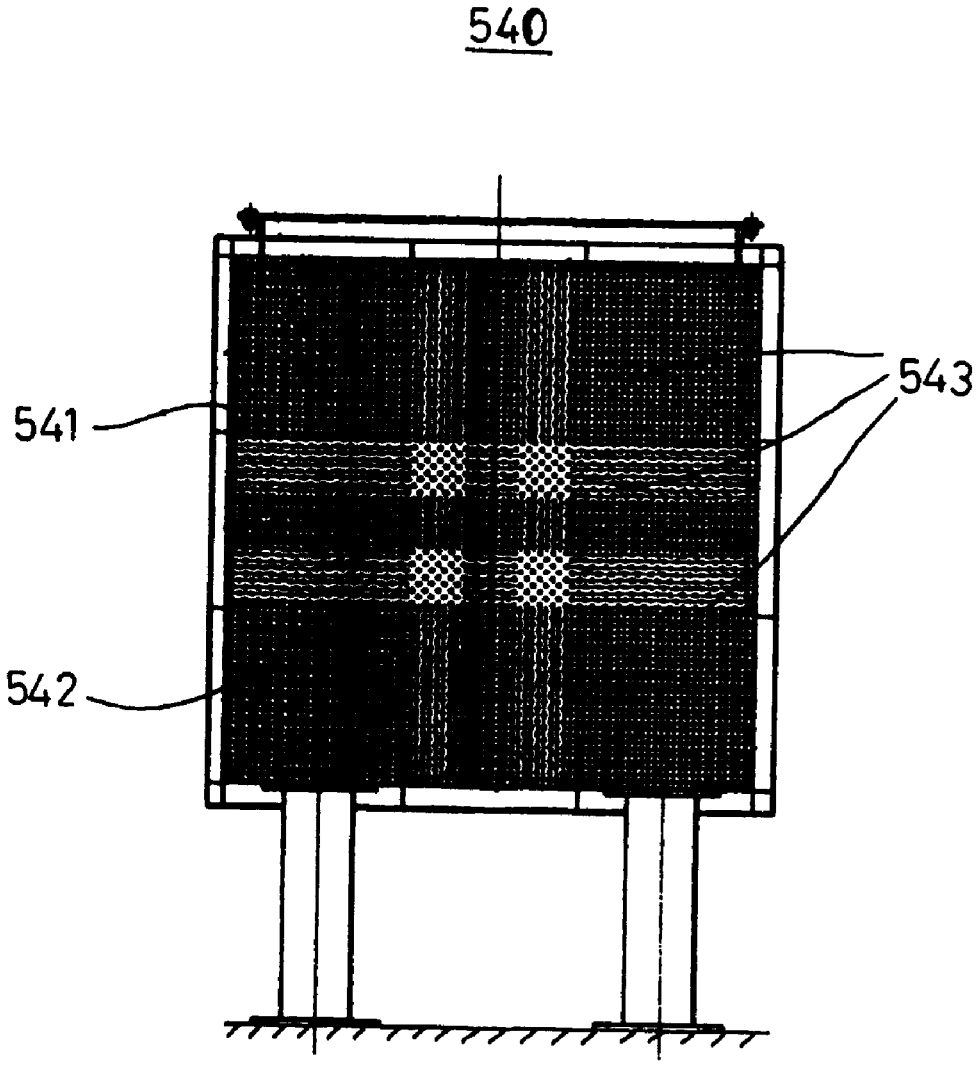
FIG. 19 is a sectional view taken along a line H-H' of FIG. 18.

The waste gas which has been discharged from this oil cyclone 530 passes through tiny holes 543 of a filter member 542 which is installed within a tank 541 of a second oil filter 540 of FIGS. 18 and 19, so as for the waste gas to be purified in the same principle as that of the first oil filter 520.

The waste oil thus separated is discharged through an oil discharge hole 544 to the waste oil purifying part 400.

Further again, the separated waste oil is spouted through an oil nozzle 560*d* of the tank 541 by the power of the high pressure pump 550, so that the spouted oil drops can capture the dusts contained in the waste gas, thereby further improving the waste gas purifying efficiency.

The waste gas, from which the harmful components such as dusts has been removed is supplied to an oil burner 610 of a burning device 600 to be burned there. At the same time, the waste oil is supplied to the oil burner 610, so that the waste gas and the waste oil can be mixedly burned.

As shown in FIG. 1, the purified waste gas is spouted through a nozzle 620 of the burning device 600, thereby more intensifying the flames.

Therefore, if the waste tire incinerating and post-treating system and the burning device such as a boiler are installed together, then the incineration and the burning of the waste gas and the waste oil can be carried out at one place, thereby improving cost effectiveness.

Figure 20:
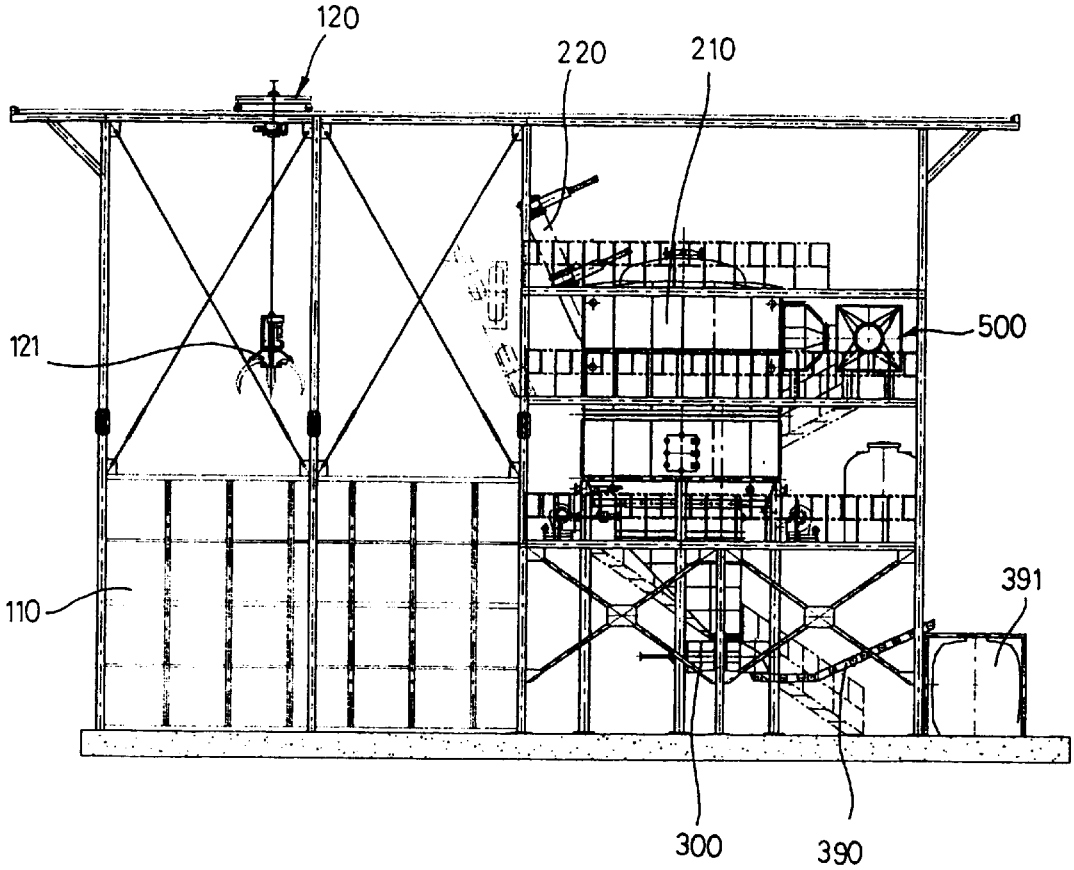
FIG. 20 is an exemplary view showing the installed state of the system according to the present invention.

Thus as shown in FIG. 20, the required facilities are installed together, thereby minimizing the installation area. Particularly, the hoist device 120 unloads the waste tires from the collecting truck C1, and loads the incineration residual materials (the combustion debris) to the collecting truck C2, thereby making the total system automatic.

According to the present invention as described above, the waste tire incinerating system is made totally automatic, and the facility cost and the installation area are reduced. Further, a continuous incineration is realized, and the waste gas purifying efficiency is improved, thereby maximizing the use of the energy.

What is claimed is:

1. A waste tire incinerating and post-treating system comprising:

an incinerating part comprising: a main air supplying pipe and a plurality of air supplying tubes; a plurality of air discharge tubes, each having a cover; and a thermally decomposing furnace for incinerating waste tires after receiving the waste tires through a feeding pipe;

a waste oil purifying part for purifying a waste oil after an incineration of the waste tires;

a waste gas purifying part comprising: first and second oil filters, an oil cooler and an oil cyclone, for purifying a waste gas generated during the incineration of the waste tires;

a waste tire reservoir tank for accommodating the waste tires before incineration of the waste tires;

a hoist device having a tongs for picking up the waste tires from the waste tire reservoir tank, and for handling compressed incineration residual material blocks;

a waste tire supplying and sensing device comprising: a chain conveyor with tire guide members installed thereon for conveying the waste tires one by one from the waste tire reservoir tank to said thermally decomposing furnace, the waste tires being transferred from said reservoir tank to said chain conveyor with said hoist; and large, medium and small tire sensors for sensing sizes of the waste tires so as to feed proper amounts of the waste tires into said thermally decomposing furnace;

said incinerating part further comprising: first and second blocking gates installed on said feeding pipe of said thermally decomposing furnace, to form a waste tire waiting space between said two gates; the waste gas leaked into said waiting space being fed back into said thermally decomposing furnace; a plurality of recycling chains running between the plurality of said air supplying tubes, for removing incineration residual materials; and a plurality of angled recycling members upstanding on each of said chains, for pushing the incineration residual materials;

an incineration residual material treating part for compressing the incineration residual materials from the incinerating part into a block to squeeze from the incineration residual materials any waste oil contained in the residual materials and to obtain compressed incineration residual material blocks; and said waste gas purifying part feeding a separated waste oil back to said waste oil purifying part after its separation from the waste gas discharged from the thermally decomposing furnace by said first and second oil filters, by said oil cooler and by said oil cyclone, and spouting the separated waste oil into tanks through oil nozzles by a power of a high pressure pump.

2. The waste tire incinerating and post-treating system as claimed in claim 1, wherein said waste tire supplying and sensing device has: a water sucking pipe movable by a cylinder to remove water from an interior of the waste tires before incineration of the waste tires; and a water discharge pump for providing a sucking power to said water sucking pipe.

3. The waste tire incinerating and post-treating system as claimed in claim 1, wherein said recycling members are angled members for pushing the incineration residual materials to a side.

4. The waste tire incinerating and post-treating system as claimed in claim 1, wherein said incineration residual material treating part comprises: a first cylinder and a first compressing plate for horizontally moving the incineration residual materials after dropping the residual materials into a residual material compressing part; second and third cylinders and second and third compressing plates for moving the materials up and down and to left and right; oil guides each having oil discharge holes for discharging the waste oil after its separation from the waste gas; and a door and an opening/closing cylinder for opening/closing a residual material outlet.

* * * * *